US005107821A

United States Patent [19]

von Blanquet

[11] Patent Number: 5,107,821

[45] Date of Patent: Apr. 28, 1992

[54] BAKING OVEN

[75] Inventor: Georg von Blanquet, Baden-Baden, Fed. Rep. of Germany

[73] Assignee: Gaggenau-Werke Haus-und Lufttechnik GmbH, Gaggenau, Fed. Rep. of Germany

[21] Appl. No.: 752,721

[22] Filed: Aug. 30, 1991

[30] Foreign Application Priority Data

Sep. 10, 1990 [DE] Fed. Rep. of Germany ..... 4028674

[51] Int. Cl.[5] ..... A21B 1/00

[52] U.S. Cl. ..... 126/19 R; 126/198; 126/273 R

[58] Field of Search ..... 126/19 R, 21 A, 198, 126/273 R, 273 A

[56] References Cited

U.S. PATENT DOCUMENTS 3,659,582 5/1972 Morgan ..... 126/198
3,889,099 6/1975 Nuss ..... 126/21 A

FOREIGN PATENT DOCUMENTS 2310290 9/1974 Fed. Rep. of Germany .
2352961 4/1975 Fed. Rep. of Germany .
2533515 2/1976 Fed. Rep. of Germany .
2656565 6/1978 Fed. Rep. of Germany .
2329024 9/1978 Fed. Rep. of Germany .
2830342 1/1980 Fed. Rep. of Germany .

*Primary Examiner*—Carroll B. Dority
*Attorney, Agent, or Firm*—Sprung Horn Kramer & Woods

[57] ABSTRACT

An oven in which at least one cooling air blower generates a cooling air current in cooling air ducting in the housing containing an incoming air duct and an exhaust air duct, this current flowing through the space in the oven door between the outer panel of the oven door and an inner panel of the oven door. A more uniform cooling action on the surface of the panel of the oven door is achieved by designing the air ducting to match the temperature distribution on the outermost panel of the oven door with a varying air flow across the width of the door, the greatest volume of air flow occurring in the middle section.

14 Claims, 2 Drawing Sheets

BAKING OVEN

BACKGROUND OF THE INVENTION

The invention relates to an oven in which at least one cooling air blower generates a cooling air current in cooling air ducting in the housing containing an incoming air duct and a discharge duct, this current flowing through the space in the oven door between the outer panel of the oven door and an inner panel of the oven door.

DE-OS 25 33 515 describes a ducted air cooling system designed to keep the outer surfaces of a cooker below predetermined maximum temperatures when the oven is in use. A cooling air blower draws in the cooling air through inlet apertures below the oven door and inlet apertures on the lower edge of the oven door. The cooling air disperses within the cooling air ducts of the housing and prevents inadmissible heat transfer from the surfaces of the thermally insulated oven muffle to the external surfaces and the bottom surface of the cooker. The oven door and the door panels are also cooled as a result of the air flow in the space between the outermost panel of the oven door and an internal panel of the oven door which is designed as a double panel.

A similar cooling system, used in a double oven, is described in DE OS 28 30 342.

Cooling of an oven door during a pyrolytic cleaning process is achieved in one cooker by several cooling air currents ducted upwards inside the oven door according to U.S. Pat. No. 4,163,444. This allows the temperature to be reduced in stages from the internal side of the oven door to the surface of the outermost panel of the oven door as a result of the parallel cooling air currents.

Finally, DE GM 87 05 364 shows a partitioned glass front covering the control panel and the oven door, the oven door being thermally isolated from the body of the door by a cooling air duct situated on the back of the glass front. The cooling air flowing upwards in the space between the body of the door and the front panel of the oven door is discharged, without specific air ducting in the lower section of the saucer-shaped glass front, through a slit aperture between the upper and lower sections.

In principle, both ascending air ducting with an exhaust air duct at the top, usefully extending over the entire width of the oven door, and air ducting directed downwards with a slit-shaped exit from the exhaust air duct below the oven door are possible. In the case of ascending air ducting and discharge from the exhaust air duct at the level of the control panel, a warm air flow which the user may find unpleasant may occur in certain circumstances.

Thus, DE AS 23 29 024 describes a division of the exhaust air ducting from the discharge side of the cooker by a flow conductor in the shape of a V-shaped wedge, so that the cooling air drawn in from below is discharged above the oven door through two discharge apertures situated at the side into the surrounding environment. This exhaust air ducting and the enlargement of the discharge area are intended, on the one hand, to reduce the temperature of the heating cooling air discharged and, on the other, to prevent air being blown directly at the user standing in front of the cooker.

A V-shaped flow conductor which diverts the flow of cooling air generated by a blower to discharge apertures situated to the side below the control panel is also described in DE OS 23 10 290 and DE OS 23 52 961. Moreover, in DE OS 26 56 565, a ridge-type flow conductor is used in an oven to guide some of the cooling air current in the vicinity of the air discharge recess at the back to the outlet of a vapor extraction duct and hence to achieve vapor extraction mixed with the discharged, heated cooling air. These known flow conductors in the vicinity of the exhaust air duct are not used in conjunction with an oven door through which cooling air flows, so that no steps are required in the known contexts to prevent the undesired reentry of the heated cooling air discharged at the outlet apertures of the exhaust air duct into the intake apertures of the oven door (short circuit ducting).

Cooling air ducting within and across the whole width of the door, which is essentially uniformly distributed, does not take adequate account of the actual temperature distribution which may result in particularly high temperatures occurring in the middle section of the outermost oven door panel.

SUMMARY OF THE INVENTION

The objective of the invention is to design an oven as described initially, such that with appropriately effective cooling air ducting increased cooling is achieved at those areas where maximum values can be expected in accordance with the temperature distribution across the whole width of the oven door. This objective is achieved by designing the air ducting to match the temperature distribution on the outermost oven door panel across the width of the door with varying volumes of air passing through, the greatest volume of air flow occurs in the middle section. A design of this type means that the cooling air requirement can be adapted to the temperature distribution in such a way that even in the area of the outermost oven door panel an essentially uniform permissible temperature is not exceeded on the external side.

Although the varied settings of the air flow volume or other flow parameters across the width of the door means that precise adaptation to the actual temperature distribution, to be determined by measurement, is possible, it would seem useful to set the air ducting in accordance with simplified assumptions such that increased cooling action is always present in the middle section, this increased cooling action setting the surface of the outermost oven door panel at a permissible maximum temperature.

The varying air flow across the width of the door can be achieved by a number of technical means. One advantageous possibility is to design the shape of at least one panel of the oven door so that the cross-section of the air duct passage in the middle section is enlarged, thus causing an increased air flow. This varying air flow recess is usefully created by the shape of the outermost panel of the oven door. To this end, the outermost oven door panel can advantageously be curved, at least in the vicinity of the vertical edges but also in its entirety. Apart from or in conjunction with these designs for the shape of the outermost oven door panel, a corresponding shape altering the cross-section of the duct can also be designed for the inner oven door panel.

If appropriate, it may be useful to incorporate at least one flow conductor element to create the varying air flow across the width of the door, this conductor reducing the current cross-section and intensity on both sides in the vicinity of the edges of the oven door in comparison with the middle section of the oven door panel. A flow conductor element of this type can advantageously be located in the space between the outermost panel of the oven door and an inner oven door panel.

Instead of the flow conductor, a series of intake apertures distributed across the width of the oven door can also be used, with a larger cross-section in the middle section than in the vicinity of the vertical outer edges.

In the case of ascending cooling air ducting in the oven door in conjunction with either a unified or a divided slit-shaped discharge recess for the exhaust air duct, located below the oven door, a large proportion of the hot air to be discharged into the surrounding area is drawn in again at the inlet recesses of the oven door if no special measures are taken and, after being drawn in, this air re-enters the general cooling air ducting of the housing. This causes short circuit ducting for a large proportion of the cooling air and adequate cooling of the walls of the housing cannot be guaranteed. In order to overcome this disadvantage, a further embodiment of the invention, which can, however, also be used in the case of an air flow which is essentially uniform across the width of the door, can provide for a flow conductor to be located in the cooling air ducting towards the outlet of the exhaust air duct, such that the heated cooling air is at least partially diverted away from the intake area of the cooling air supply to the oven door.

A flow conductor of this type may usefully be located symmetrically in the middle section upstream of the outlet of the exhaust air duct extending below the oven door across the whole width of the door, such that the exhaust air is diverted from the middle section to the peripheral areas below the door. The flow conductor is advantageously designed to diverge in the direction of the current flow and is usefully triangular in shape.

Another advantageous design can, if appropriate, be achieved by locating the flow conductor for asymmetrical guidance of the air current, such that the heated cooling air is discharged on one side in the vicinity of that edge of the oven door situated on the same side as the vertical axis of rotation of the oven door. This prevents the user from standing in the heated exhaust air current when he or she takes hold of the handle to open the oven door.

A flow conductor of this type can usefully be designed to be reversible in accordance with the door stop, which can be fixed on either side as desired. This makes it possible to set the discharge of the exhaust air current at the side away from and opposite to the handle in every case. An advantageous design of the reversible flow conductor can provide for the latter being a pivoting air deflector.

Both the symmetrical flow conductor and the flow conductor designed for asymmetrical air guidance can, if appropriate, be fitted with thermal insulation supplementing the reduced thermal insulation in the vicinity of the flow conductor. To this end, the flow conductor can either be made of a heat-insulating material, for example plastic, or, in the case of a thin-walled metal design, it can have a filling of insulating material.

The invention will be explained in more detail below on the basis of embodiment examples which will demonstrate further characteristic features of the invention and on the basis of the drawings wherein:

DETAILED DESCRIPTION OF THE INVENTION

Figure 1:
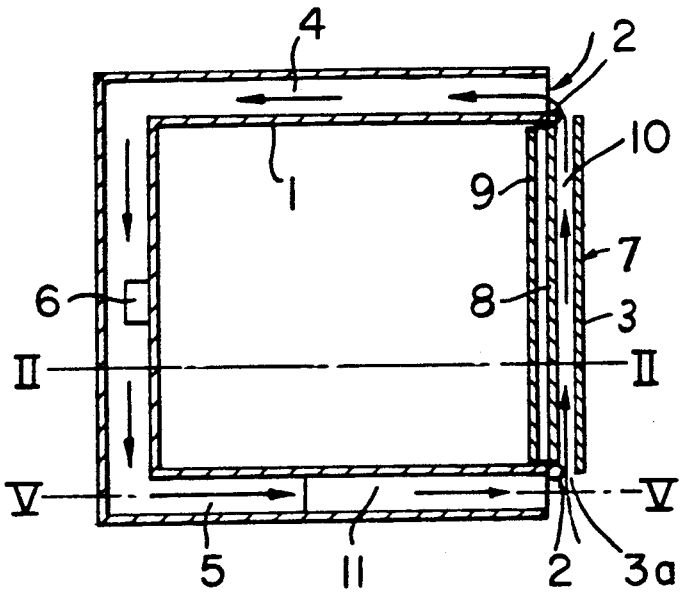
FIG. 1 shows a vertical section along line I—I in FIG. 2 through a built-in oven with cooling air ducted in an ascending fashion in the oven door.

The sectional view in FIG. 1 shows an oven muffle 1 which, if appropriate, has additional thermally insulating material on its external side and which is closed at the front by an oven door 3, connected on hinged bearings 2 about a vertical swivelling axis. A cooling air blower 6 is provided in the cooling air ducting of the housing which contains a cooling air intake duct 4 and an exhaust air duct 5.

The oven door 3 with ascending air ducting from an intake slit 3*a* has an outermost oven door panel 7 and an inner oven door panel designed as a double panel 8, 9. Between the inner side of the outermost oven door panel 7 and the outer side of the inner oven door panel 8 is a cooling duct 10 in the oven door 3 which permits variable air throughout across the width of the door with a maximum in the middle section.

Figure 2:
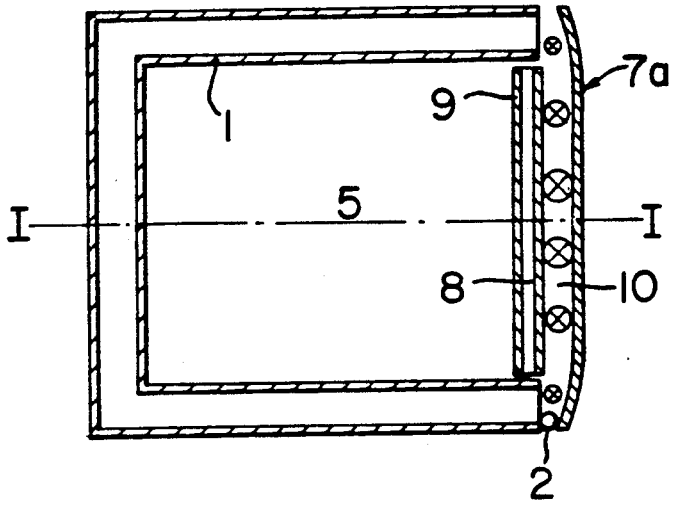
FIG. 2 shows a horizontal section along line II—II in FIG. 1 with the outermost panel of the oven door curved at the edges.

In the design shown in FIG. 2, the outermost oven door panel 7*a* is curved inwards in the vicinity of its external vertical edges so that the penetration cross-section of the cooling duct 10 and hence the air flow volume is reduced towards the sides and concentrated on the middle section.

Figure 3:
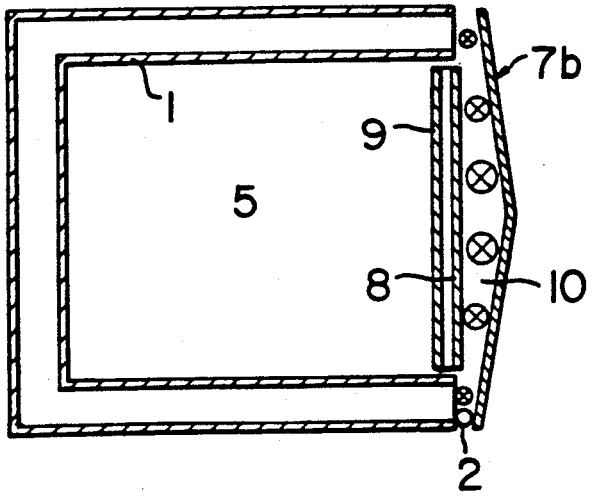
FIG. 3 shows a horizontal section along line II—II in FIG. 1 with the outermost panel of the oven door bent in the shape of a roof.

The embodiment in FIG. 3 shows a ridge-type design of the outermost oven door panel 7*b*, bent in the vicinity of the bisecting line. In this case, maximum air throughout is again achieved in the middle section of the cooling duct 10.

Figure 4:
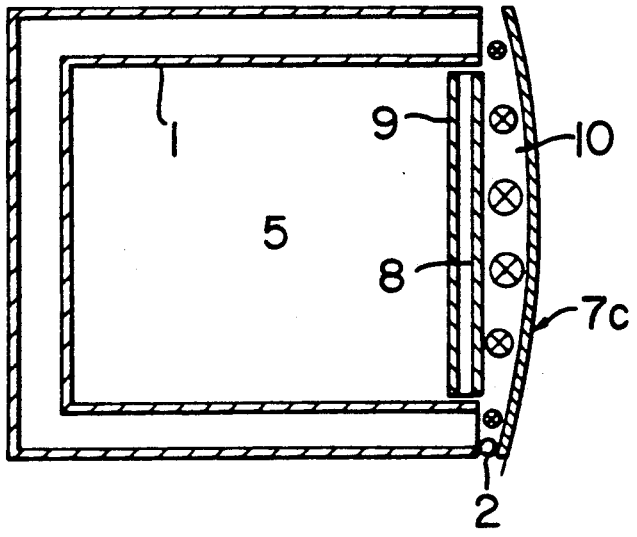
FIG. 4 shows a horizontal section along line II—II in FIG. 1 with the outermost panel of the oven door curved throughout.

Finally, FIG. 4 shows a continuously curved outermost oven door panel 7*c* with which a continuous variation of the width of the cooling duct 10 is achieved.

Figure 5:
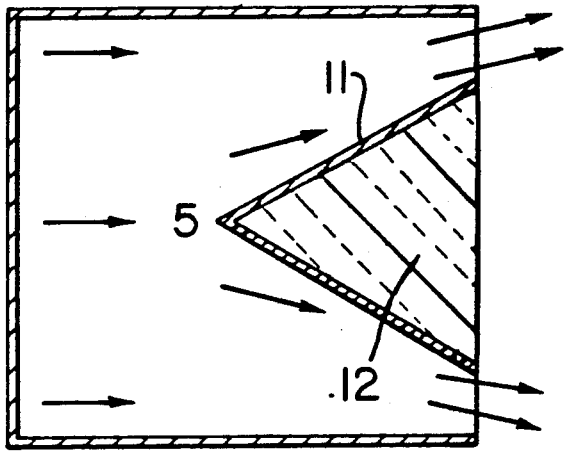
FIG. 5 shows a horizontal section along line V—V in FIG. 1 with a symmetrical flow conductor inserted in the exhaust air duct.

The sectional view in FIG. 5 shows a triangular flow conductor 11 located in the exhaust air duct 5 (cf. FIG. 1) symmetrically to the middle section upstream of the outlet of the exhaust air duct, such that the heated cooling air from the vicinity of the intake slit 3*a* on the bottom of the oven door 3 is diverted towards the two sides of the door. This is intended to prevent hot exhaust air from the exhaust air duct 5 being drawn in at the intake slits 3*a* of the oven door 3 to form a short circuit. The oven door 3, which is designed in accordance with the embodiment in FIG. 4, can thus draw in cool ambient air via the intake slit 3*a*. The symmetrical flow conductor 11 is lined internally with a filling of insulating material 12.

Figure 6:
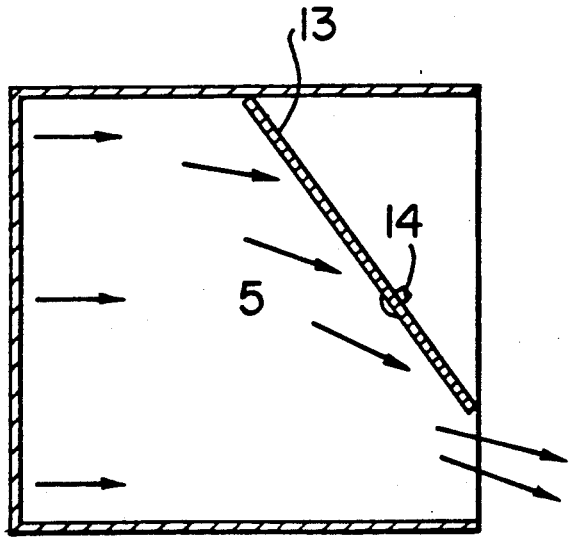
FIG. 6 shows a horizontal section along line V—V in FIG. 1 with a flow conductor for asymmetrical deflection of the air flow inserted in the exhaust air duct.

FIG. 6 shows a flow conductor designed as a pivoting air deflector 13 which can be reversed in accordance with the optional selection of the door stop of the oven door 3. This flow conductor permits discharge on one side of the heated cooling air in the marginal area of the oven door 3 situated on the side of the vertical axis of rotation of the oven door 3 and away from the side on which the handle of the oven door 3 is located. This means that the user does not stand directly in the region of the heated exhaust air current when opening the oven door. The embodiment in FIG. 6 shows the door stop on the left and discharge of the heated cooling air in the vicinity of the left-hand edge of the oven door, adapted in accordance with the location of the door stop. If the door stop is situated on the right side, the air discharge can be set to the right marginal area by simply reversing the air deflector 13 about pivot 14 after removal of the exhaust air duct 5 ventilation grid on the front, which is not shown.

In FIGS. 2 to 6, ascending air currents are indicated schematically by circles with crosses in them. The remaining details of the oven design, which have not been explained in detail, correspond to known state of the art models.

In addition to the exhaust air from the cooling duct 10 between the oven door panels 7, 8, fresh air from the surrounding environment also enters the cooling air intake duct 4, as shown by an arrow in FIG. 1.

What is claimed is:

1. An oven comprising: a housing having a door movable between an open and closed position; means forming cooling air ducting around the housing including an incoming air duct and an exhaust air duct; at least one cooling air blower for producing a cooling air current in the air ducting; and means forming cooling air ducting on the oven door comprising an inner door panel and an outer door panel and means for matching the temperature distribution on the outer door panel across the width of the door with a varying air flow wherein the greatest volume of air flow occurs in a middle section thereof.

2. The oven in accordance with claim 1, wherein the means for matching the temperature distribution with a varying air flow rate comprises the shape of at least one oven door panel.

3. The oven in accordance with claim 2, wherein the means for matching the temperature distribution with varying air flow rate comprises the shape of the outer oven door panel.

4. The oven in accordance with claim 3, wherein the outer oven door panel is curved, at least in the vicinity of vertical edges thereof.

5. The oven in accordance with claim 1, further comprising a flow conductor element.

6. The oven in accordance with claim 5, wherein the flow conductor element is located in said exhaust air duct.

7. The oven in accordance with claim 1, further comprising a flow conductor element in the cooling air ducting towards an outlet of the exhaust air duct to divert heated cooling air at least partially away from an intake area of a cooling air supply to the oven door.

8. The oven in accordance with claim 7, wherein the flow conductor is located symmetrically in a middle section upstream of the outlet of the exhaust air duct extending across the width of the door below the oven door to pass exhaust air from the middle section into peripheral areas below the door.

9. The oven in accordance with claim 8, wherein the flow conductor is configured to diverge in a direction of the flow.

10. The oven in accordance with claim 9, wherein the flow conductor is triangular in shape.

11. The oven in accordance with claim 7, wherein the door has a vertical axis of rotation and the flow conductor for effecting asymmetrical guidance of the current is located such that the heated cooling air emerges on one side in a peripheral area of the oven door situated on the side of the vertical axis of rotation of the oven door.

12. The oven in accordance with claim 11, further comprising means mounting the flow conductor to be reversible depending on the optional position of a door stop.

13. The oven in accordance with claim 12, wherein the reversible flow conductor comprises a pivoting air deflector.

14. The oven in accordance with claim 7, wherein the flow conductor is fitted with thermal insulation.

* * * * *